US007766681B1

(12) United States Patent
Wang

(10) Patent No.: US 7,766,681 B1
(45) Date of Patent: Aug. 3, 2010

(54) WATERPROOF ELECTRIC PLUG OR RECEPTACLE FOR LED LIGHT STRING

(75) Inventor: Sheng Lien Wang, Hsinchu County (TW)

(73) Assignee: Ting Shen Industrial Co., Ltd., Hsinchu (TW)

( * ) Notice: Subject to any disclaimer, the term of this patent is extended or adjusted under 35 U.S.C. 154(b) by 66 days.

(21) Appl. No.: 12/320,312

(22) Filed: Jan. 23, 2009

(51) Int. Cl.
*H01R 13/52* (2006.01)

(52) U.S. Cl. ..... 439/276; 439/76.1; 439/936; 439/620.27

(58) Field of Classification Search ..... 439/76.1, 439/271–276, 620.27, 936
See application file for complete search history.

(56) References Cited

U.S. PATENT DOCUMENTS 6,325,668 B1 * 12/2001 Sato et al. ..... 439/587
6,390,854 B2 * 5/2002 Yamamoto et al. ..... 439/620.15
6,729,889 B2 * 5/2004 Bauer ..... 439/67
6,881,077 B2 * 4/2005 Throum ..... 439/76.1
7,048,564 B1 * 5/2006 Hinze ..... 439/276
7,294,007 B1 * 11/2007 Lawlyes ..... 439/276
7,484,981 B2 * 2/2009 Garcia et al. ..... 439/271
7,563,139 B1 * 7/2009 Wang ..... 439/638

* cited by examiner

*Primary Examiner*—James Harvey
(74) *Attorney, Agent, or Firm*—Bacon & Thomas, PLLC

(57) ABSTRACT

Waterproof electric plug or receptacle for LED light string is provided. In one embodiment, the plug includes a housing comprising two prongs, two fuses, an internal space, rear passages, compartments between the space and the passages, a wall for separating the space and the compartments; an electrical assembly comprising a PCB electrically to the prongs via the fuses, and rear conductive posts in the compartments; a power cord passing the passages and having two sleeves secured to the posts, and a shell mounted around the housing. Waterproof adhesive is applied on the wall, the compartments, and front and rear ends of the PCB.

7 Claims, 7 Drawing Sheets

WATERPROOF ELECTRIC PLUG OR RECEPTACLE FOR LED LIGHT STRING

BACKGROUND OF THE INVENTION

1. Field of Invention

The invention relates to power connectors and more particularly to a waterproof electric plug or receptacle for a light string including a plurality of LED (light-emitting diode) bulbs.

2. Description of Related Art

One conventional type of Christmas light string is comprised of a plurality of LED bulbs. Electrical components of an electric plug or receptacle for the conventional Christmas light string are required to be waterproof since such type of conventional Christmas light string is typically disposed in an outdoor environment. Unfortunately, waterproof performance of such type of conventional Christmas light string is very poor. Thus, a need for improvement exists.

SUMMARY OF THE INVENTION

It is therefore one object of the invention to provide a waterproof electric plug or receptacle for an LED light string.

The above and other objects, features and advantages of the invention will become apparent from the following detailed description taken with the accompanying drawings.

DETAILED DESCRIPTION OF THE INVENTION

Figure 1:
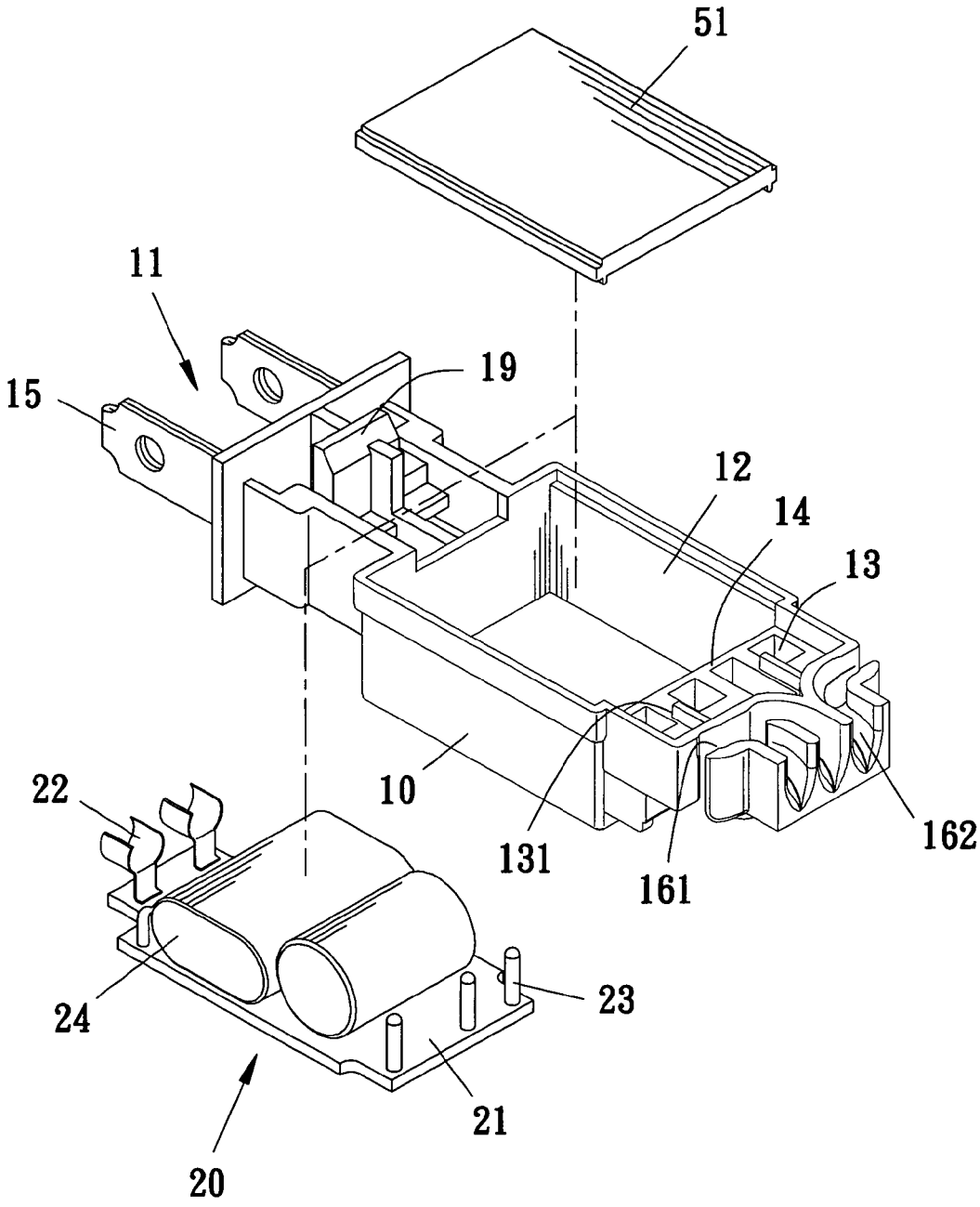
FIG. 1 is an exploded view of a first preferred embodiment of waterproof electric plug for LED light string according to the invention.
Figure 2:
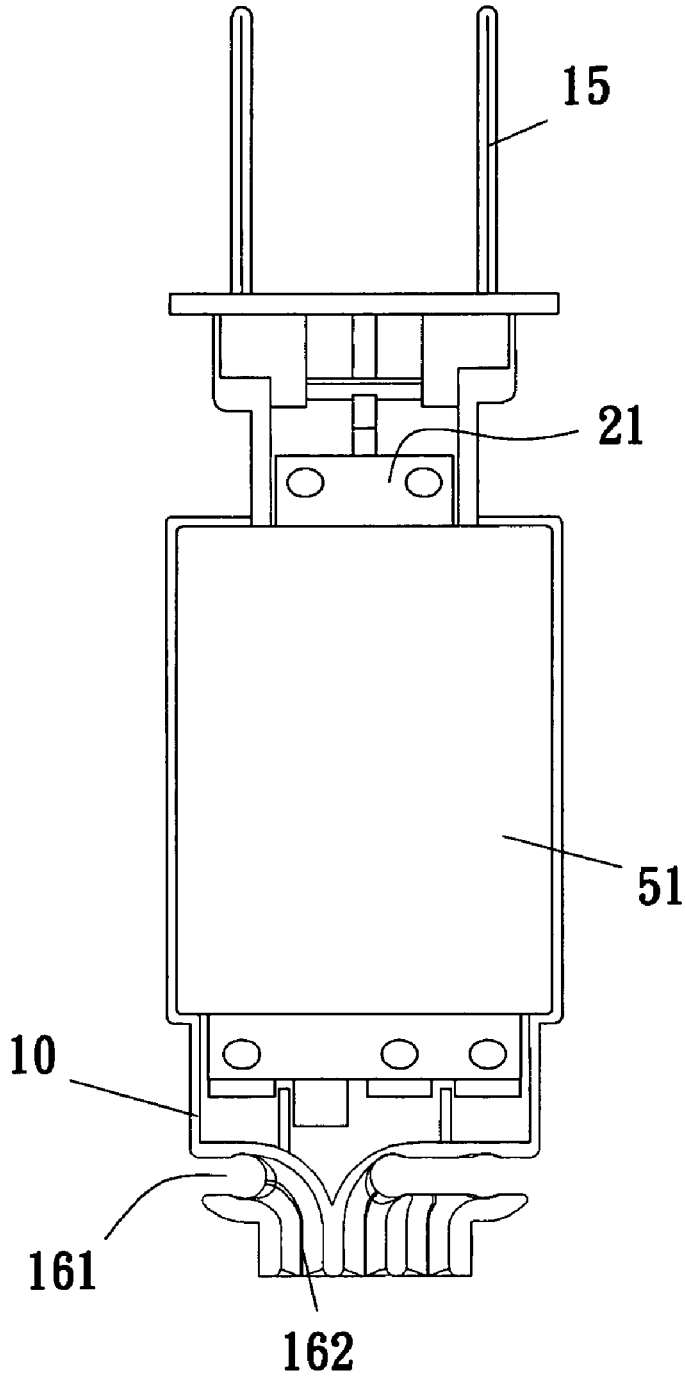
FIG. 2 is a top plan view of the assembled electric plug.
Figure 3:
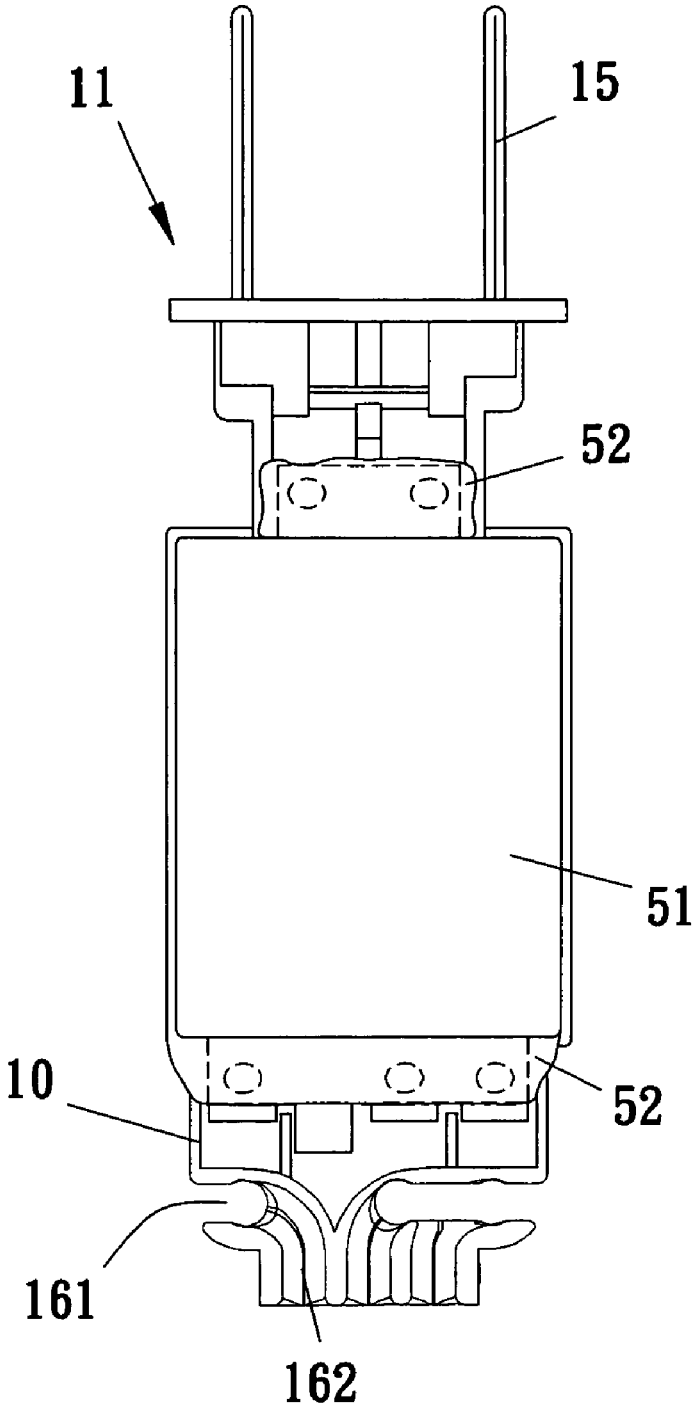
FIG. 3 is a view similar to FIG. 2 where waterproof adhesive has been applied for protecting internal components.
Figure 4:
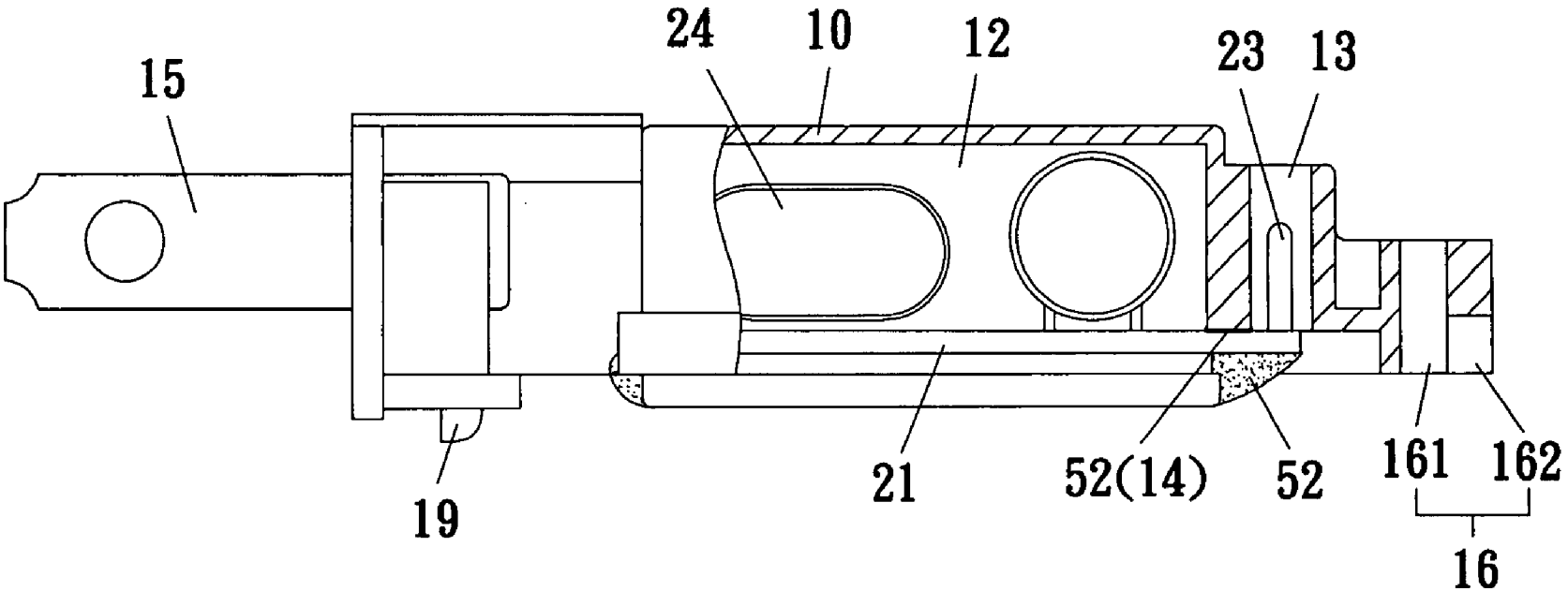
FIG. 4 is a sectional view of rear portion of the electric plug of FIG. 3.
Figure 5:
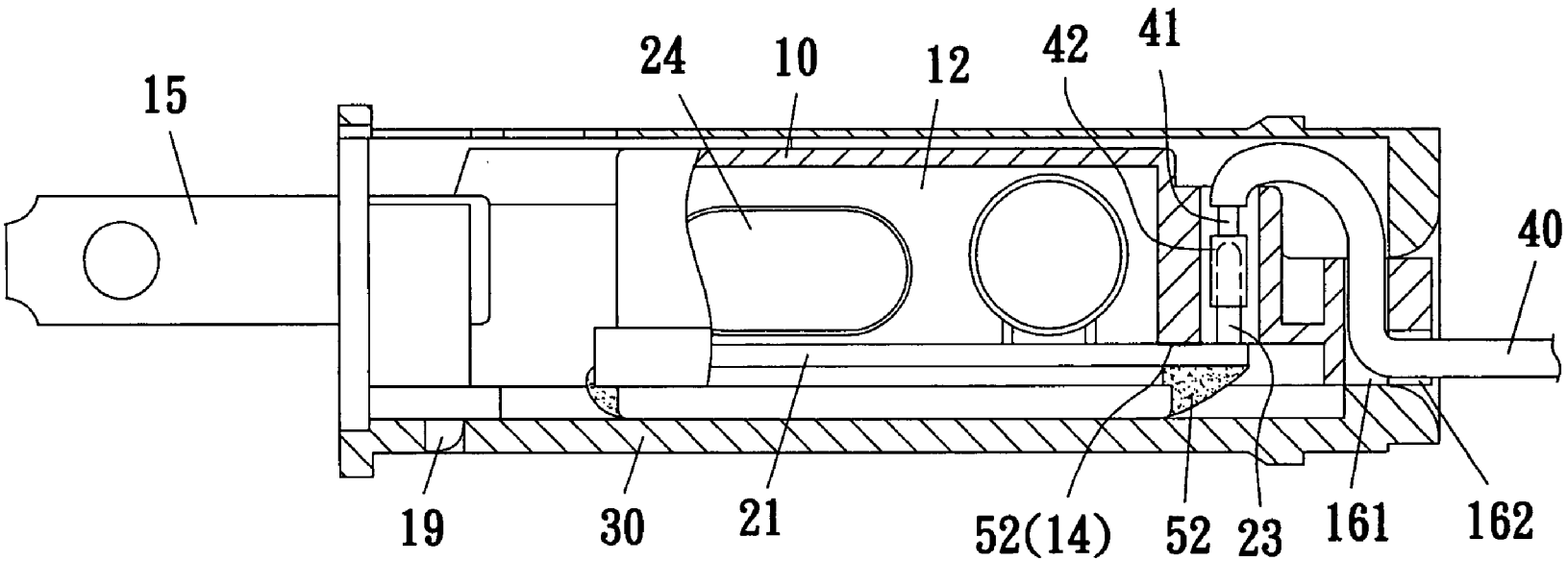
FIG. 5 is a view similar to FIG. 4 where power cord is connected to the electric plug.

Referring to FIGS. 1 to 5, a waterproof electric plug for an LED light string in accordance with a first preferred embodiment of the invention is shown. The electric plug comprises the following components as discussed in detail below.

An insulative housing 10 is formed of plastic and comprises a contact portion 11 having two prongs 15 at front end and fuses (not shown), an internal space 12, a rear section 16 having bent passages 161 having an end opening 162, a plurality of small compartments 13 formed between the space 12 and the rear section 16, a plurality of dividers 131 each formed between two adjacent compartments 13, a wall 14 for separating the space 12 and the compartments 13, and a latch 19 formed between the contact portion 11 and the space 12.

An electrical assembly 20 is mounted in the housing 10 and comprises a printed circuit board (PCB) 21, two spaced conductive supports 22 at front end with the fuses electrically disposed thereon (i.e., electrically to the prongs 15), a plurality of contact posts 23 at rear end, and a plurality of electrical members 24 on the PCB 21, the electrical members 24 including a rectifier, a voltage stabilizer, and other components.

A power cord 40 passes the opening 162 of the passage 161 and has a conductor 41 having a conductive sleeve 42 put on the contact post 23 for fastening and electrically connecting thereto.

The electrical members 24 are disposed in the space 12 with the contact posts 23 disposed in the compartments 13. Further, the housing 10 is closed by snapping a cover 15 thereon after mounting the electrical assembly 20 therein. Furthermore, waterproof adhesive 52 is applied on the wall 14, the compartments 13, and front and rear ends of the PCB 21 since they are not covered by the cover 51.

A shell 30 is mounted around the housing 10 by securing to the latch 19.

In the embodiment, the contact posts 23 are male members and the sleeves 42 are female members. In other embodiments, the contact post (i.e., male member) may be formed on end of the power cord and the sleeves (i.e., female members) may be formed on the PCB.

It is envisaged by the invention that a waterproof electric plug for LED light string is thus constructed. It is noted that the dividers 131 have the function of preventing short circuit from occurring since the electrical components in the space 12 are separated from the power cord 40 by the dividers 131.

Figure 6:
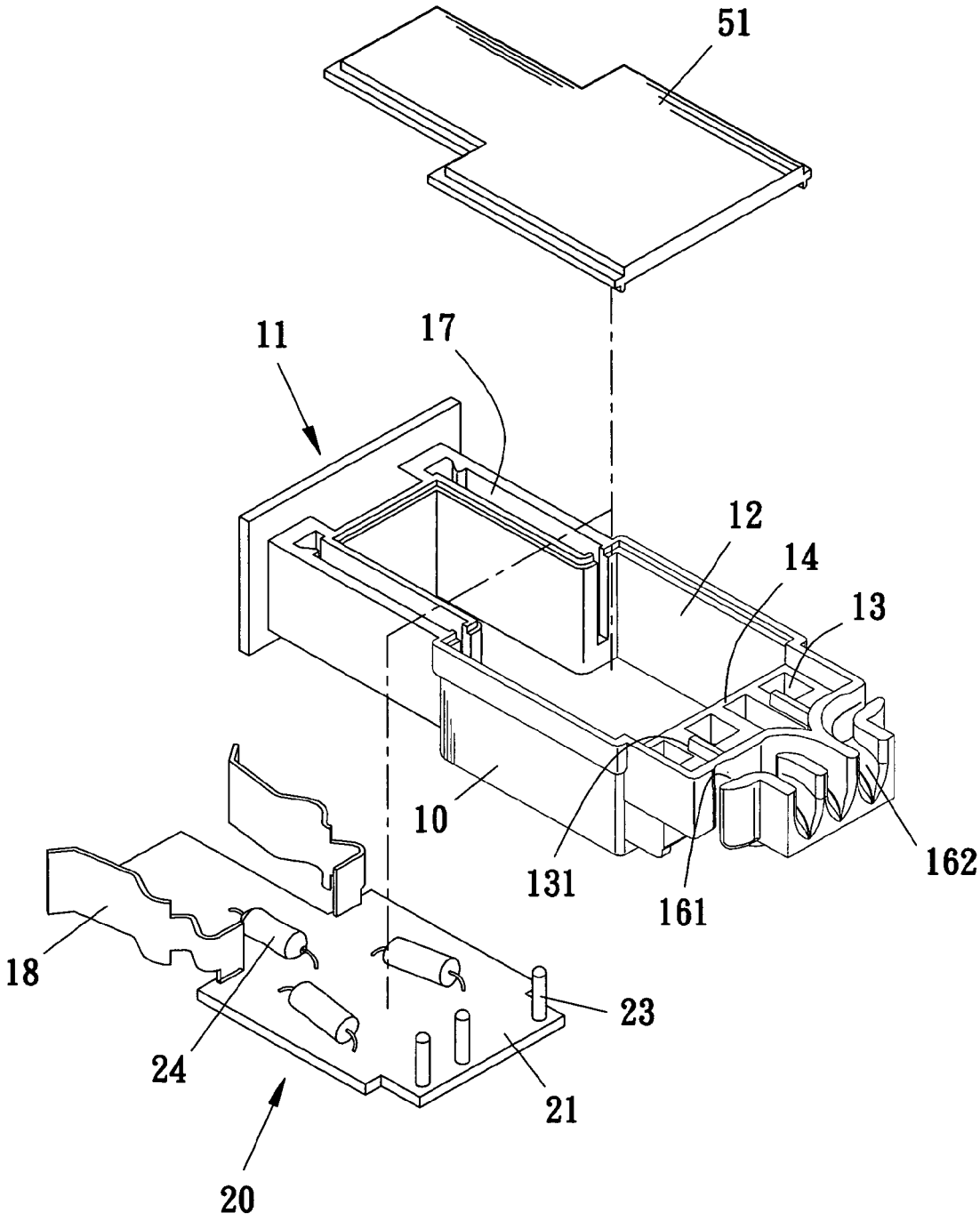
FIG. 6 is an exploded view of a second preferred embodiment of waterproof receptacle for LED light string according to the invention.
Figure 7:
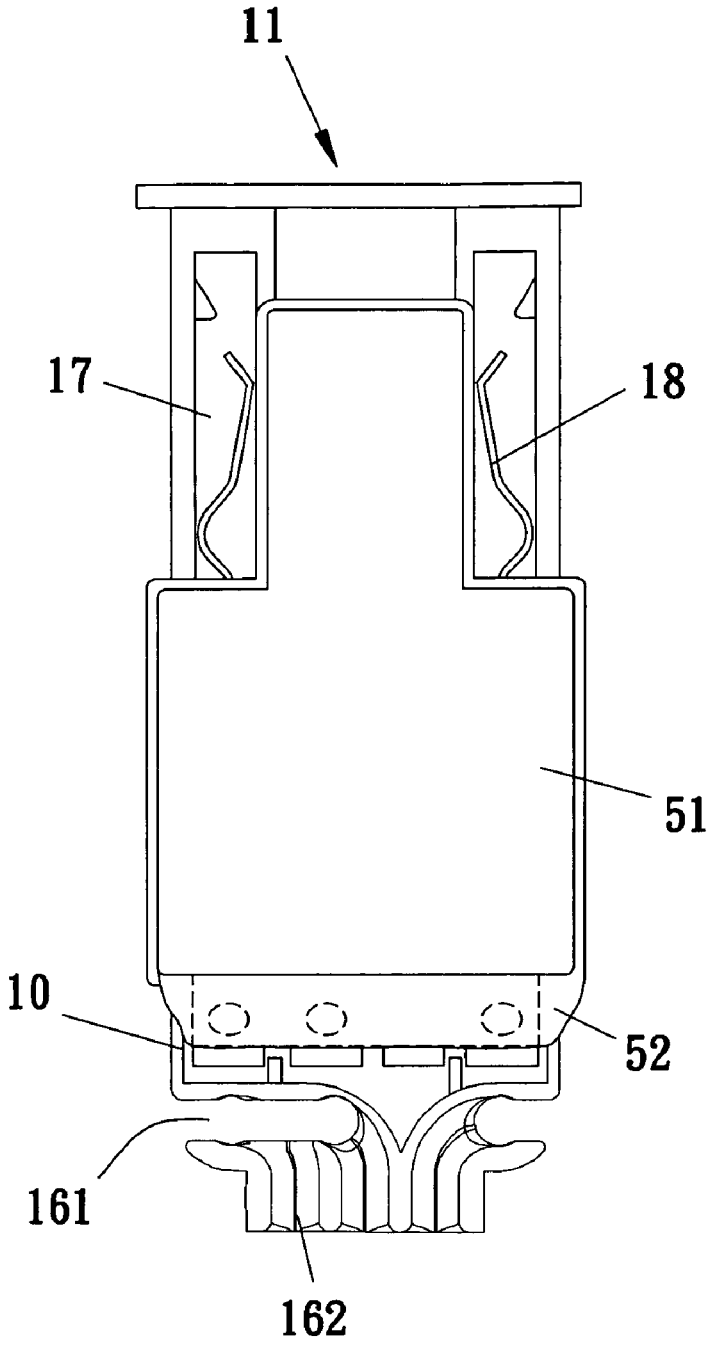
FIG. 7 is a top plan view of the assembled receptacle where waterproof adhesive has been applied for protecting internal components.

Referring to FIGS. 6 and 7, a waterproof receptacle for an LED light string in accordance with a second preferred embodiment of the invention is shown. The characteristics of the second preferred embodiment are detailed below.

Two front slots 17 having a front opening (not shown) are provided in the housing 10. The openings of the slots 17 are adapted to receive and electrically connect to the prongs of an electric plug. Two front conductive pieces 18, as a replacement of the conductive supports 22, are provided on the PCB 21 and are fastened in the slots 17 by pressing.

While the invention herein disclosed has been described by means of specific embodiments, numerous modifications and variations could be made thereto by those skilled in the art without departing from the scope and spirit of the invention set forth in the claims.

What is claimed is:

1. An electric plug for a light string including a plurality of LED bulbs, comprising:

an insulative housing comprising two first prongs, an internal space, two fuses disposed in the space and electrically to the first prongs, a plurality of rear passages, a plurality of compartments between the space and the passages, a wall for separating the space and the compartments, a latch between the first prongs and the space, and a cover;

an electrical assembly comprising a PCB, two front conductive supports with the fuses disposed thereon and electrically thereto, a plurality of rear mating conductive contacts disposed in the compartments, and a plurality of electrical members formed on the PCB and disposed in the space;

a power cord passing the passages and having two corresponding mating conductive contacts secured to the mating conductive contacts and electrically connecting thereto; and a shell mounted around the housing by securing to the latch, wherein waterproof adhesive is applied on the wall, the compartments, and front and rear ends of the PCB.

2. The electric plug of claim 1, wherein the mating conductive contacts are posts and the corresponding mating conductive contacts are sleeves.

3. The electric plug of claim 1, wherein the mating conductive contacts are sleeves and the corresponding mating conductive contacts are posts.

4. The electric plug of claim 1, wherein the housing further comprises a grounding second prong.

5. A receptacle for a light string including a plurality of LED bulbs, comprising:

an insulative housing comprising two front slots having an opening, an internal space, a plurality of rear passages, a plurality of compartments between the space and the passages, a wall for separating the space and the compartments, and a cover;

an electrical assembly comprising a PCB, two front conductive members disposed on the PCB and fastened in the slots, a plurality of rear mating conductive contacts disposed in the compartments, and a plurality of electrical members formed on the PCB and disposed in the space; and a power cord passing the passages and having two corresponding mating conductive contacts secured to the mating conductive contacts and electrically connecting thereto, wherein waterproof adhesive is applied on the wall, the compartments, and front and rear ends of the PCB.

6. The receptacle of claim 5, wherein the mating conductive contacts are posts and the corresponding mating conductive contacts are sleeves.

7. The receptacle of claim 5, wherein the mating conductive contacts are sleeves and the corresponding mating conductive contacts are posts.

* * * * *